US005709442A

United States Patent [19]

Feldpausch et al.

[11] Patent Number: 5,709,442

[45] Date of Patent: Jan. 20, 1998

[54] LOCK SYSTEM FOR CASEGOODS

[75] Inventors: Thomas G. Feldpausch, Hastings; Phillip D. Carino, Grand Rapids; Frederick S. Faiks, Greenville; David M. DeBoer; Samuel J. Ellison, both of Grand Rapids; Daniel N. Siegrist, Kentwood, all of Mich.

[73] Assignee: Steelcase Inc., Grand Rapids, Mich.

[21] Appl. No.: 628,551

[22] Filed: Apr. 10, 1996

Related U.S. Application Data

[62] Division of Ser. No. 138,638, Oct. 15, 1993, Pat. No. 5,533,798.

[51] Int. Cl.[6] ..... E05B 65/46

[52] U.S. Cl. ..... 312/221; 312/222

[58] Field of Search ..... 312/216, 217, 312/218, 219, 220, 221, 222, 333; 292/158, 161, 35

[56] References Cited

U.S. PATENT DOCUMENTS

| | | | |
|---|---|---|---|
| 205,866 | 7/1878 | Hoyt . | |
| 446,997 | 2/1891 | Stroh et al. . | |
| 1,136,254 | 4/1915 | Mosler et al. . | |
| 1,180,123 | 4/1916 | Florcken . | |
| 1,700,557 | 1/1929 | Cherniack et al. . | |
| 1,866,684 | 7/1932 | Van Der Leun . | |
| 2,547,513 | 4/1951 | Wikman . | |
| 2,548,578 | 4/1951 | Andersson et al. . | |
| 2,695,574 | 11/1954 | Ceci . | |
| 3,323,849 | 6/1967 | Stark . | |
| 3,325,234 | 6/1967 | Lewin . | |
| 3,378,321 | 4/1968 | Frederick et al. . | |
| 3,404,929 | 10/1968 | Wright et al. . | |
| 3,539,236 | 11/1970 | Miller . | |
| 3,584,905 | 6/1971 | Emenaker . | |
| 3,767,280 | 10/1973 | McLaughlin | 312/219 |
| 3,799,638 | 3/1974 | Faiks . | |
| 3,866,993 | 2/1975 | Dean et al. . | |
| 3,888,558 | 6/1975 | Himsl . | |
| 3,957,324 | 5/1976 | Klenik, Jr. et al. . | |
| 4,199,176 | 4/1980 | Kelly . | |
| 4,298,236 | 11/1981 | Laroche . | |
| 4,429,930 | 2/1984 | Blouin . | |
| 4,447,098 | 5/1984 | Parker . | |

(List continued on next page.)

FOREIGN PATENT DOCUMENTS

| | | | |
|---|---|---|---|
| 92357 | 1/1922 | Switzerland | 312/218 |
| 1579315 | 11/1980 | United Kingdom | 312/222 |

*Primary Examiner*—Peter M. Cuomo
*Assistant Examiner*—Gerald A. Anderson
*Attorney, Agent, or Firm*—Price, Heneveld, Cooper,DeWitt & Litton

[57] ABSTRACT

A lock system for casegoods, such as desks, cabinets, storage units, wardrobes and the like, includes an elongated, flexible tape or lock member having a plurality of spaced lock studs positioned thereon. A lock actuator moves the tape between unlocked and locked positions. Catches are mounted on the drawers, doors and the like of the article. When the flexible tape is moved to the locked position, the lock studs block or prevent opening movement of the drawers or doors due to contact with the catches. The flexible tape is routed through channels or other mounting structure formed in panels and tops of the article of furniture. An interlock mechanism, which may be integrated with the lock member, includes a lock lever, a cable attached to the lock lever and a plurality of interlock cams. Control members on the drawers rotate the cams to take up the cable causing the interlock lever to pivot and engage the lock member, thereby moving the lock member to a locked position. The interlock mechanism may include a plurality of force generating members which act upon the lock member upon the opening of a drawer. The force generated by each of the members is insufficient in and of itself to move the tape to the locked position. The force generated by two of the members is, however, sufficient to move the tape to a locked position, thereby preventing opening of a second drawer.

10 Claims, 7 Drawing Sheets

U.S. PATENT DOCUMENTS 4,469,382 9/1984 Slaats et al. .
4,492,418 1/1985 Bailey et al. .
4,662,689 5/1987 Chatterson et al. .
4,762,346 8/1988 King .
4,770,476 9/1988 Lakso .
4,960,309 10/1990 Scheerhorn .
5,062,678 11/1991 Westwinkel .
5,064,256 11/1991 Shepherd .
5,076,015 12/1991 Manzalini .
5,176,436 1/1993 Mitchell .
5,199,774 4/1993 Hedinger et al. .
5,387,032 2/1995 Reisbeck ..... 312/217
5,427,445 6/1995 Mitchell ..... 312/216

LOCK SYSTEM FOR CASEGOODS

This is a divisional of application Ser. No. 08/138,638, filed on Oct. 15, 1993 now U.S. Pat. No. 5,533,798.

BACKGROUND OF THE INVENTION

The present invention relates to articles of furniture or casegoods, such as desks, cabinets, storage units, wardrobes and the like, and, more particularly, to a lock system for such articles of furniture.

A wide variety of lock systems have been proposed for casegoods such as desks, file cabinets, credenzas, wardrobes and the like which have a plurality of drawers, doors and the like. It is desirable to lock all drawers or doors from a single remote location. In a typical system, an elongated, rigid metal lock bar or rod is provided. The bar is mounted in the article of furniture for vertical movement between unlocked and locked positions. The bars support a plurality of lock pins or studs. Catches mounted on the individual drawers and doors engage the studs to prevent opening thereof when the lock rod is in the locked position. Generally, such systems are gravity dependent. Gravity returns the bar to the unlocked position.

Prior systems have been difficult to integrate into different articles of furniture which include multiple drawers, doors and the like at different locations. Such systems include multiple rigid components which have presented installation problems and reliability problems. Such prior systems, due to their inherent weight, have not interfaced well with both manual and electrical or electronic lock systems. The weight of such systems has required relatively large and powerful solenoid actuators. In addition, problems are experienced with integrating such prior systems into wood furniture. Warpage, wood chips, particles, shavings and the like in the wood panels and tops of such articles of furniture may cause the mechanism to bind thereby preventing proper operation. An example of one prior lock system including a rigid locking bar may be found in U.S. Pat. No. 3,539,236 entitled PEDESTAL DESK WITH DRAWER LOCK, which issued on Nov. 10, 1970 to Miller.

In many casegood applications, such as in vertical and lateral filing cabinets a need exists for an interlock mechanism. Such a mechanism prevents opening of more than one drawer at a time. This reduces the possibility of cabinet tipping. Prior interlock systems have taken many different forms. Such systems have not generally been easily added or integrated with a lock system. Existing interlocks may suffer from additional problems relating to complexity, difficulty in assembly and duplication of parts. In many prior approaches, the interlock mechanism is completely independent in operation from that of the cabinet lock mechanism. Examples of prior interlock and lock systems may be found in commonly owned U.S. Pat. No. 4,960,309 entitled DRAWER LOCK AND INTERLOCK MECHANISM, which issued on Oct. 2, 1990 to Scheerhorn; commonly owned U.S. Pat. No. 3,799,638 entitled DRAWER INTERLOCK, which issued on Mar. 26, 1974 to Faiks; and U.S. Pat. No. 3,404,929 entitled INTERLOCKING OF SELECTED UNITS OF A STORAGE SYSTEM, which issued on Oct. 8, 1968 to Wright et al.

A need exists for a lock system which provides reliable remote locking and unlocking of drawers, doors and the like and which may be easily and readily integrated into a full range of articles of furniture, including desks, credenzas, file cabinets, bins, wardrobes and other casegoods. A need exists for a system which may be manufactured at reduced cost, which reduces installation errors, interfaces well with manual and electrical or electronic lock actuators, which readily accommodates warpage and the like found in wood furniture and which easily provides an interlock function.

SUMMARY OF THE INVENTION

In accordance with the present invention, the aforementioned needs are fulfilled. Essentially, a lock system is provided including an elongated lock member mounted for movement in an article of furniture between locked and unlocked positions. The lock member includes a plurality of spaced lock studs or pins which cooperate with catches mounted on the moveable units such as drawers and doors of the article of furniture. A lock actuator is operatively connected to the lock member.

In other aspects of the invention, the lock member is an elongated, flexible tape which is readily routed through the article of furniture. The tape, due to its reduced weight and flexibility, is readily accommodated into a wide range of articles of furniture, readily accommodates warpage of wood panels and interfaces well with mechanical and electrical or electronic actuators. The lock member provides a smooth and quiet operating system due to self-lubricating properties of the presently preferred tape material. The system is readily used with wood or metal furniture.

In further aspects of the invention, drawer catches each include a one-way, flexible ramp and an anti-tamper projection. The ramp permits the drawers to be closed when the lock member has been shifted to a locked position but prevents reopening thereof. Door catches are provided which are engaged by lock studs on the tape. In an alternative embodiment, the tape pivots door lock members pivoted to the article of furniture and which engage catches mounted on the doors.

In still further aspects, interlock mechanisms are provided which readily integrate with the lock mechanism to prevent opening of more than one drawer at a time. In one embodiment, the interlock mechanism includes a lever pivoted to the article of furniture. The lever includes an end engaging the lock member. A cable is connected to another end of the lever and also to ground. A plurality of actuating cams are rotatably mounted on the article of furniture. The cams are rotated upon opening movement of a drawer to take up the cable causing the lever to rotate and the lock member to shift to the locked position. In another embodiment, a plurality of force generating members operatively engage the lock member when a drawer is opened. Each member individually generates a force which is insufficient to raise the lock member to the locked position. Two of the members, however, generate a sufficient force to raise the lock member to the locked position. Catches mounted on the drawers are dimensioned and configured to permit one drawer to open but to prevent opening of a second drawer.

The flexible tape readily accommodates warpage and other problems which may be encountered in wood furniture. The tape is easily integrated into the full range of wood and metal furniture pieces. The tape, due to its reduced weight, is easily interfaced with manual and electrical or electronic lock actuators. The system readily accommodates an interlock mechanism for casegood applications requiring such. The system is easy to install, provides the necessary installation adjustability and is reliable in operation.

DETAILED DESCRIPTION OF THE PREFERRED EMBODIMENT

Figure 1:
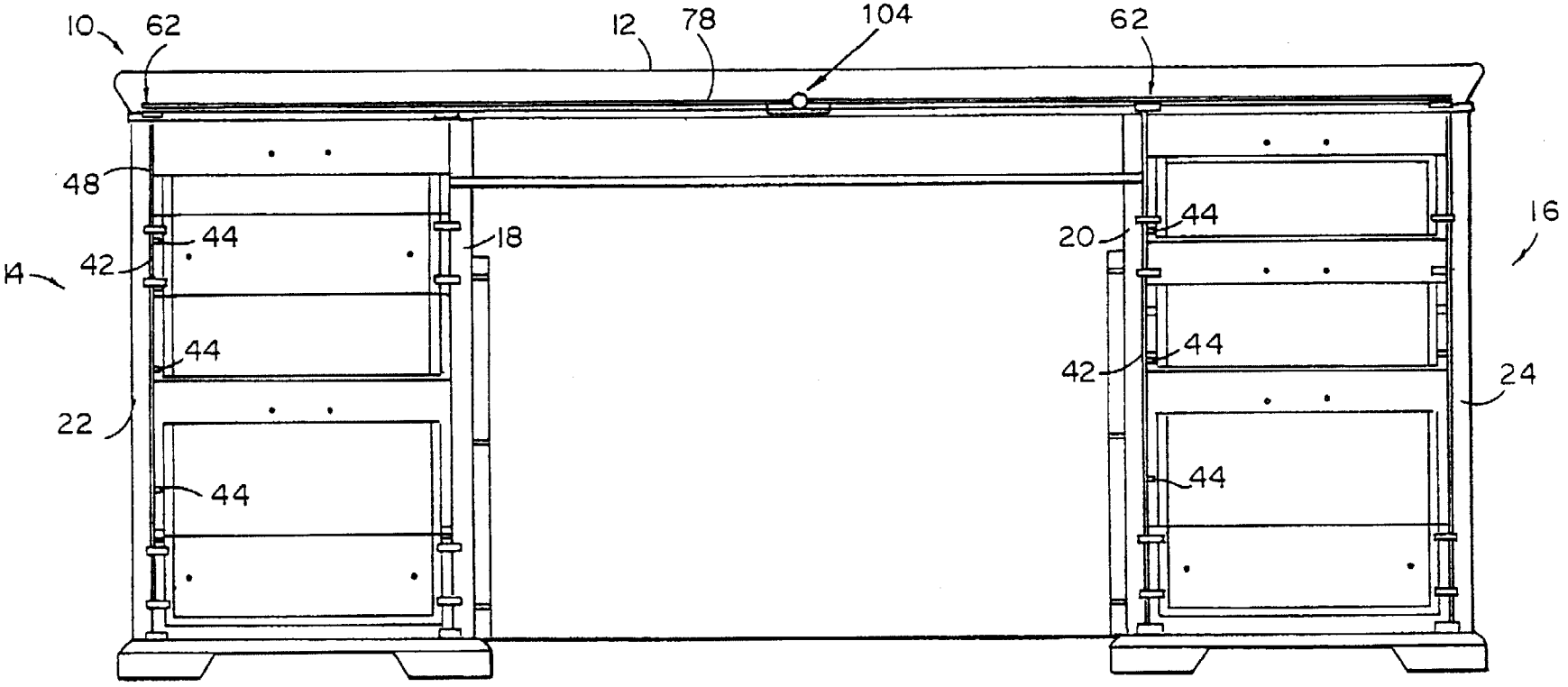
FIG. 1 is a front, elevational view of a double pedestal desk incorporating a lock system in accordance with the present invention.
Figure 2:
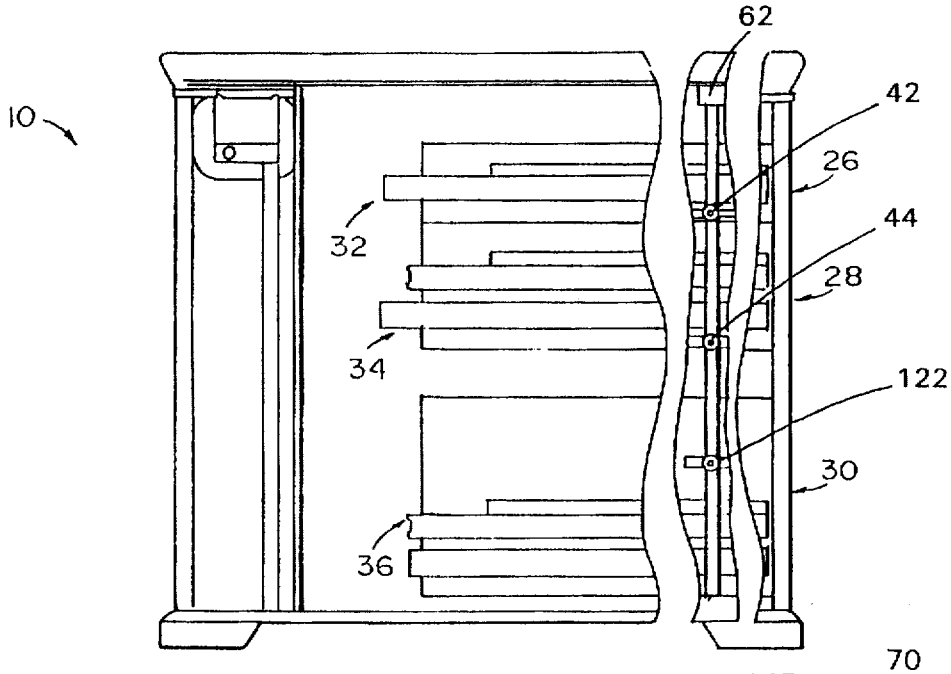
FIG. 2 is a fragmentary, side, elevational view of the desk of FIG. 1.

A double pedestal wood desk incorporating a lock system in accordance with the present invention is illustrated in FIGS. 1 and 2 and generally designated by the numeral 10. Desk 10 includes a horizontal work surface or top 12 and pedestals 14, 16. Pedestals 14, 16 include inner panels 18, 20 and outer panels 22, 24, respectively. Each pedestal 14, 16 slideably mounts vertically stacked drawers 26, 28 and 30 (FIG. 2). The drawers are slideably mounted on conventional hardware 32, 34 and 36 attached to the side panels.

Figure 3A:
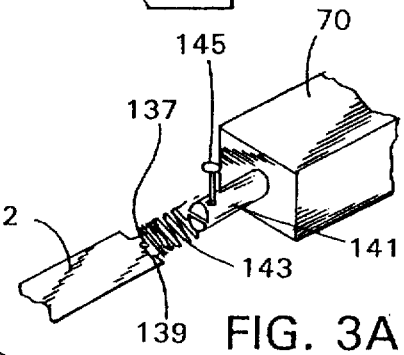
FIG. 3A is an exploded view of a solenoid actuator included in the lock system.
Figure 3:
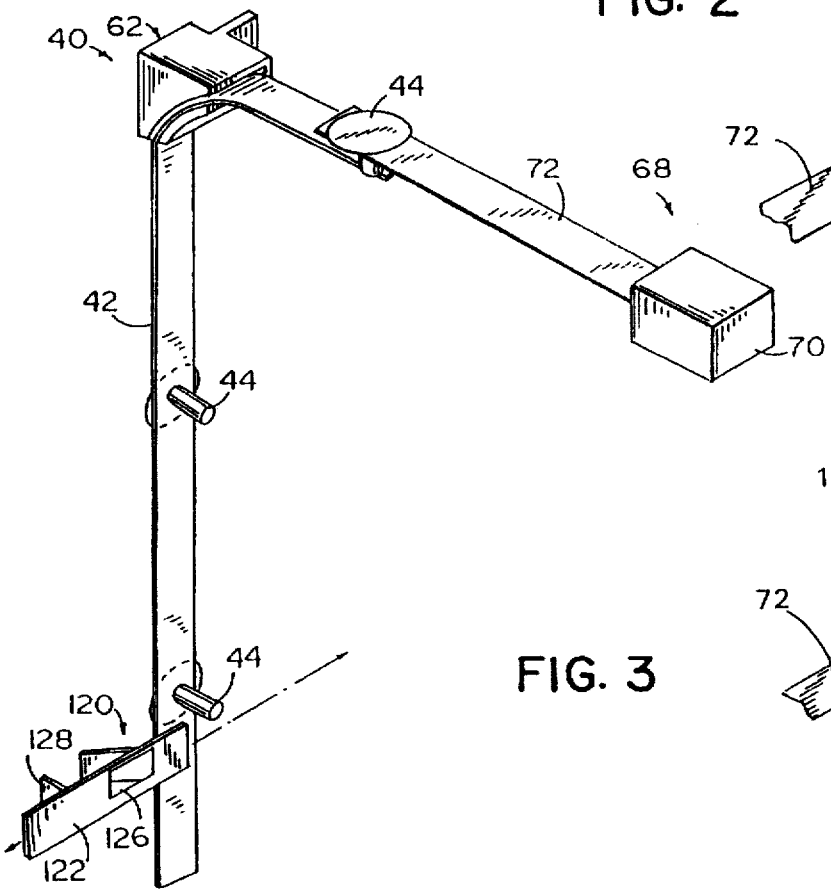
FIG. 3 is a schematic view illustrating a lock system in accordance with the present invention.
Figure 8:
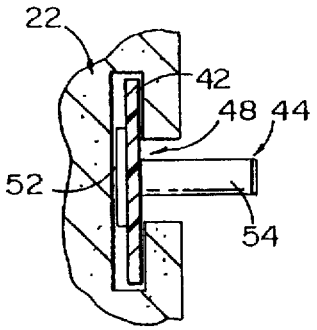
FIG. 8 is a cross-sectional view taken generally along line VIII—VIII of FIG. 5.

A lock system generally designated 40 in FIG. 3 is incorporated into desk 10. Lock system 40 includes an elongated lock member 42 which supports a plurality of vertically spaced lock pins or studs 44. In the embodiment of FIGS. 1, 2 and 3, lock member 42 is an elongated, flexible tape. The tape is laterally flexible and not stretchable or longitudinally flexible within the expected range of actuating forces applied thereto. Tape 42 is routed through panel 22 of pedestal 14 within a T-shaped groove 48 formed within panel 22. As illustrated in FIG. 8, panel 22 of the embodiment illustrated is fabricated from wood. Groove 48 provides a channel-like structure for mounting lock member 42 for vertical movement within the panel. Each stud 44 includes a head 52 and a stem, shaft or pin portion 54. As illustrated, lock studs 44 are mounted on tape 42 by press-fitting stud portion 54 through an aperture formed in tape 42. Panel 20 of pedestal 16 defines a similar T-shaped slot or channel 48 which receives another elongated, flexible lock tape 42 therein. This tape also supports a plurality of lock studs 44.

Figure 4:
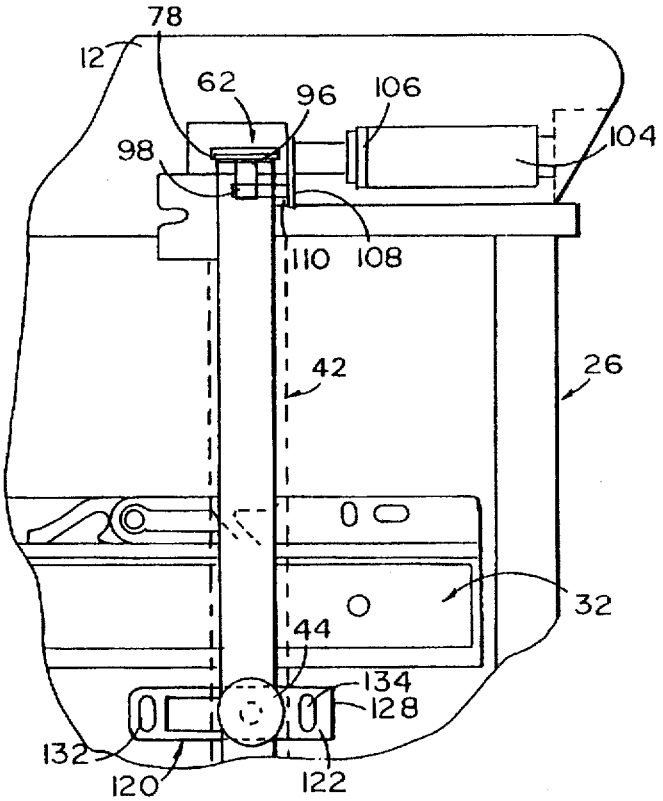
FIG. 4 is a fragmentary, enlarged view of a portion of the desk of FIG. 1.
Figure 5:
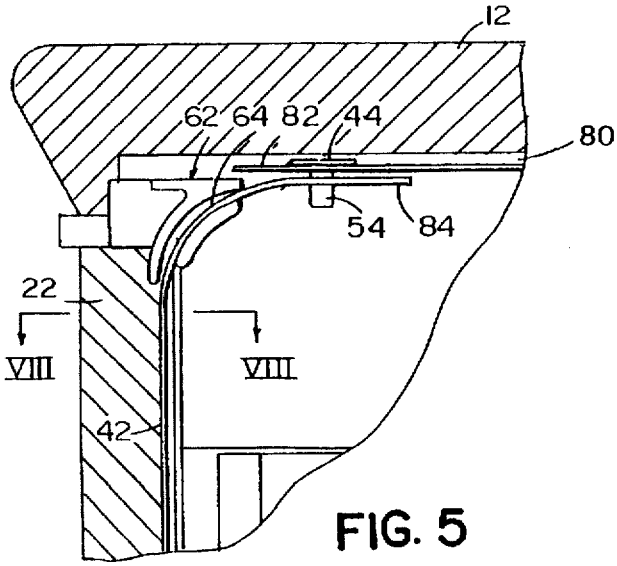
FIG. 5 is a fragmentary, enlarged, front, elevational view of a portion of the desk of FIG. 1.

As best seen in FIGS. 1, 4 and 5, lock tape 42 is routed vertically within panel 22 of pedestal 14 and passes through a corner guide 62. Guide 62 defines a slot 64 which receives tape 42. Guide 62 is secured at the corner defined by top 12 and side panel 22. Lock tape 42 mounted within pedestal 16 also is guided and routed through a corner tape guide 62. As shown in FIG. 1, such guide is positioned at the corner defined by top 12 and inner panel 20 of pedestal 16 (FIG. 7).

As schematically illustrated in FIG. 3, lock member 42 is moved from a lowered, unlocked position to a raised, locked position through an actuator 68. Actuator 68 may include a mechanical lock actuator or electrical actuator, such as a solenoid, schematically illustrated and designated by the numeral 70. Actuator 70 is connected to an upper end of tape 42 by a length of flexible tape 72. As shown, tape 72 may be connected to tape 42 by a stud 44.

Figure 7:
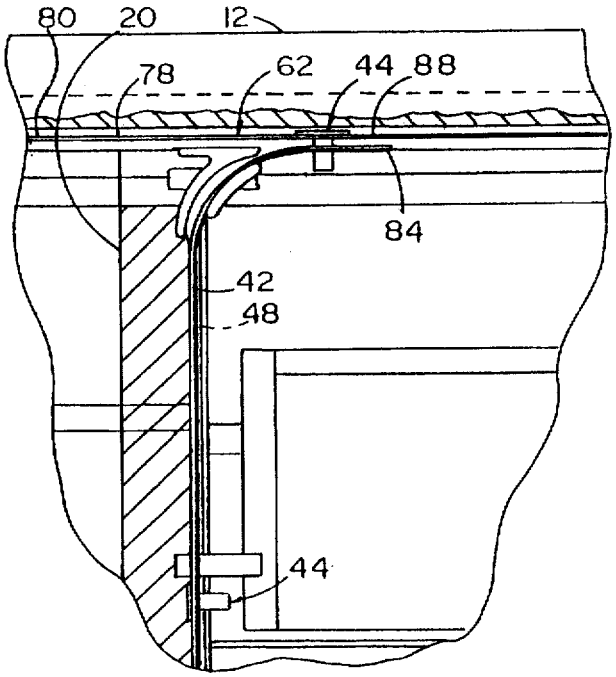
FIG. 7 is an enlarged, fragmentary, front, elevational view of another portion of the desk of FIG. 1.

In the embodiment of FIGS. 1, 2, 4, 5 and 7, an elongated interconnecting tape 78 extends within a groove or slot 80 formed in the undersurface of top 12. As shown in FIG. 5, tape 78 is connected at one end 82 to an upper end 84 of lock tape 42 by a stud 44. Stud portion 54 is press-fitted through apertures formed in both tape members. As shown in FIG. 7, an opposite end 88 is connected to upper end 84 of tape 42 in pedestal 16 by another stud 44 in the same fashion. As should be apparent, movement of tape 78 to the right, when viewed in FIG. 1, will raise both lock tapes 42 from a lowered to a raised or locked position. Movement to the left will move the tapes downwardly within their respective panels 22, 20 to an unlocked position.

Figure 6:
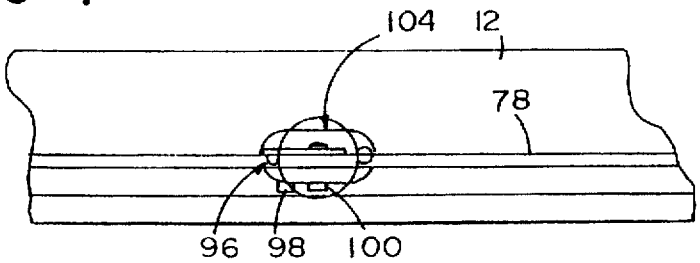
FIG. 6 an enlarged, fragmentary, elevational view of a portion of the mechanical actuator incorporated in the desk of FIG. 1.

In the embodiment of FIG. 1, a mechanical key lock or actuator is provided to shift tape 78. As shown in FIGS. 4 and 6, tape 78 includes a double stud 96 mounted thereon having spaced stud portions 98, 100. The mechanical lock 104 or manual actuator includes a lock barrel 106. A cam plate 108 is attached to lock barrel 106. Cam plate 108 includes a pin 110 (FIG. 4) which extends into the space or slot defined by spaced stud portions 98, 100 of double stud 104. Rotation of barrel 106 in a conventional fashion shifts cam pin 110 to the right and left, thereby shifting connecting tape 78 and moving tapes 42 between their unlocked and locked positions.

As illustrated in FIG. 3, each drawer is provided with a catch 120. Catch 120 includes a base 122 and an inclined one-way ramp 124. Catch 120 is preferably manufactured from a resilient material, such as spring steel, so that ramp 124 will hinge or flex about its attachment point or hinge line 126 with base 122. As should be apparent from FIG. 3, an open drawer may be closed after lock member 42 is moved to its locked position. Ramp 124 will engage a stud 44 and move towards base 122 until it passes the stud. Opening movement of the drawer is, however, prevented due to engagement of stud 44 with one-way ramp 124.

A tamper-proof partition 128 is formed on base 122 of catch 120 in spaced relationship with ramp 124. Partition 128 prevents or reduces the possibility of using a tool to reach a stud 44 to raise or lower tape 42 and, hence, break into the desk. As shown in FIG. 4, catch 120 is provided with vertical attachment slots 132, 134. Slots 132, 134 provide a range of adjustment of the catch relative to lock tape 42 and studs 44 during installation.

The operation of the lock system in the embodiment of FIGS. 1–8 should now be readily apparent. With actuator 104 set to position connecting tape 78 and lock tapes 42 in their lowered or unlocked position, drawers 26, 28 and 30 may be readily opened. Upon rotation of the lock barrel of lock 104 so as to shift tape 78 to the right when viewed in FIG. 1, lock tapes 42 mounted in each pedestal 14, 16 are raised. The tapes position the stud portions 54 of each stud 44 so that they will block or be engaged by catches 120 mounted on each of the drawers. Centralized and remote locking and unlocking of all of the drawers of the desk is provided.

The flexible tape is readily routed through the furniture and easily interconnected for ganged operation of both locking systems in each pedestal. The tape readily accommodates any warpage which might occur in wood furniture. In wood furniture, the tape eliminates the need for separate metal mounting channels and the like to support the lock member on the desk. The tape is readily mounted in side panels of the pedestals by cutting the grooves or channels directly into the panels. Channel shapes other than the T-shape shown could be used. When used with metal furniture, metal channel pieces may readily be provided for attachment to the sides of the furniture piece.

A range of adjustment is provided and the lock is easily installed. Tape 42 may be provided with apertures at predetermined locations for ease of installation of the studs. The tape could be obtained from the manufacturer without apertures. The apertures for the studs could be punched prior to installation by the furniture manufacturer at predetermined locations for the particular article of furniture to minimize alignment problems and reduce installation error. The tape is lightweight when compared to prior locking systems. As a result, the tape lock system is readily adapted to electrical and electronic locking systems. The lightweight of the tape reduces the power requirements for the solenoid actuators.

Figure 3B:
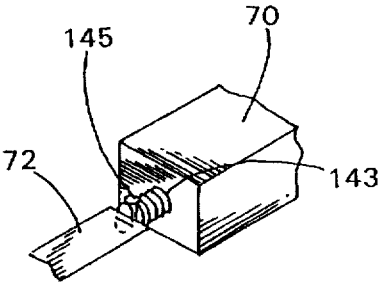
FIG. 3B is an assembled view of the actuator of FIG. 3A.

When incorporated in an electrical or electronic lock system, it is presently preferred that actuator 70 be a magnetically-latching solenoid with an integral return spring. The magnetic latch allows the system to remain in a locked position without power consumption. In the event of power failure, the lock system remains in the state in which it was in when the power failed. Relatively low cost actuators may be used to shift lock tape 42. It is also preferred that the actuator be spring biased to an unlocked position. This insures that a residual pull force in the solenoid will not raise the lightweight tape. As shown in FIGS. 3A and 3B, an end 137 of tape 72 defines an aperture 139. Actuator 70 includes a slotted plunger 141. A coil spring 143 is positioned over end 137 of tape 72. The tape is then slid into the slot of plunger 141. A retention pin 145 is then passed through plunger aperture 147 and tape aperture 139. Spring 143 is trapped between solenoid 70 and pin 145 to bias plunger 141 outwardly resiliently. The tape 72 is resiliently biased to the unlocked position. In the alternative, the tape 42 could be biased at its opposite end by a spring or by a weight attached thereto.

The lock tape is moved in a positive fashion between locked and unlocked positions. The system is not gravity dependent as in prior lock arrangements. The system allows separate lock members to be easily ganged together using inexpensive tape. A system having significantly reduced complexity from that heretofore found is provided. Reliability in operation is improved.

It is presently preferred that tape 42 be fabricated from UHMW polyethylene. The corner tape guards are fabricated from a plastic material such as acetal celcon M90. Drawer catches 190 are fabricated from spring steel 1050 and provided with a black zinc finish for aesthetic purposes. Lock studs 44 are fabricated from C1008 CRS. The double lock stud 96 may be fabricated from thirty percent glass-filled nylon. The glass-filled nylon provides sufficient strength for reliability and also a self-lubricating interface with the lock cam.

Drawer and Door Lock System

Figure 9:
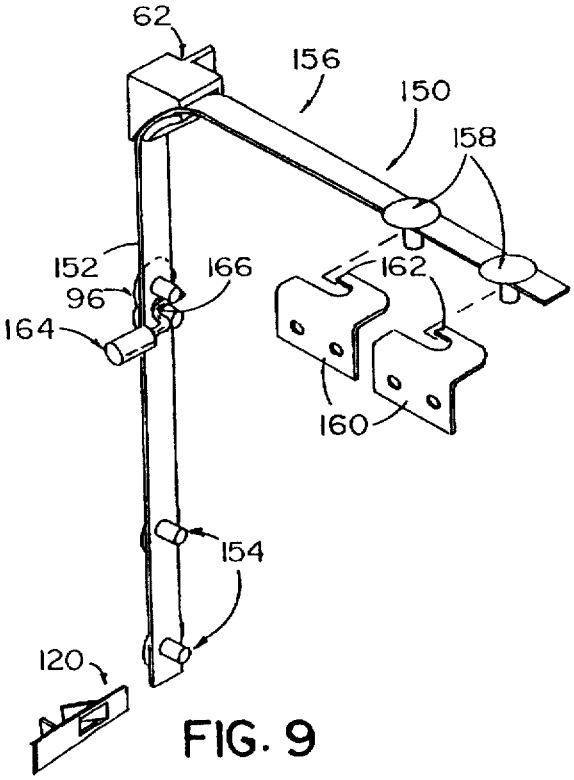
FIG. 9 is a schematic view of an alternative lock system in accordance with the present invention providing combined door and drawer locking.
Figure 10:
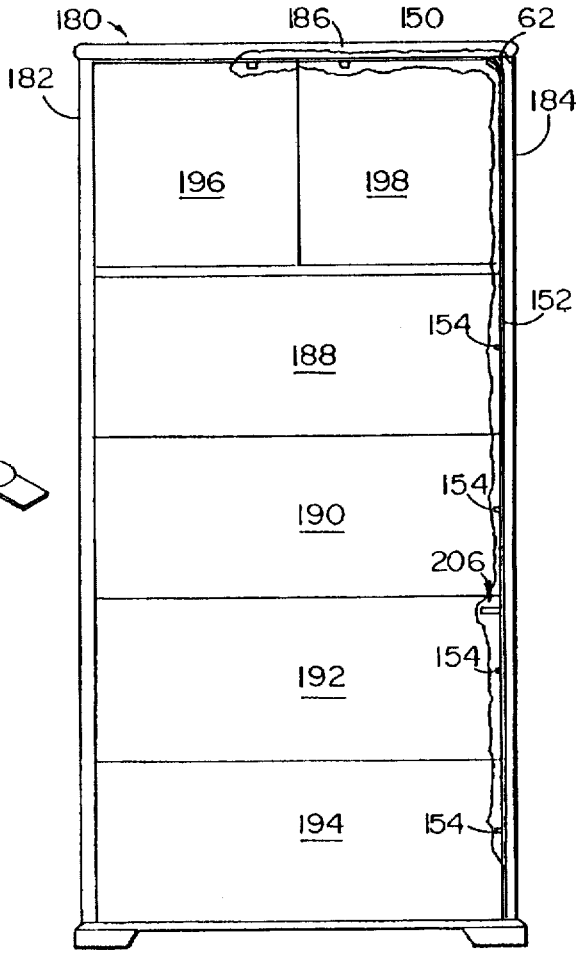
FIG. 10 is a front, elevational view of an article of furniture incorporating another lock system in accordance with the present invention.

An alternative embodiment of the present invention is illustrated in FIGS. 9–15. This embodiment is readily adaptable to vertical cabinet casegoods and other casegoods which include drawers and doors. As schematically illustrated in FIG. 9, lock system 150 includes an elongated, flexible tape 152 supporting drawer studs 154 positionable to engage drawer catches 120. Tape 152 is guided through a corner guide 62 and includes a horizontal run or portion 156. A pair of drawer studs 158 are mounted on horizontal portion 156 in spaced relationship. Door catches 160 are mounted on the upper edges of separate doors (not shown). Door catches 160 each define hook-shaped portions 162. A manual actuator 164 is mounted in a vertical side portion of the cabinet. Actuator 164 includes an L-shaped lever 166 received within the slot defined by double stud 96. Manual actuator 164 will raise and lower the tape. Raising the tape 152 shifts door studs 158 into engagement with hook portions 162, thereby latching the doors upon which catches 160 are mounted. The flexible tape is easily routed through the article of furniture so that drawers may be locked by the same tape or an extension thereof may be used to lock doors.

A vertical cabinet incorporating the dual drawer and door lock schematically shown in FIG. 9 is illustrated in FIGS. 10–15 and generally designated by the numeral 180. Cabinet 180 includes side panels 182, 184 and a top 186. A plurality of drawers 188, 190, 192 and 194 are slideably mounted between panels 182, 184 in a conventional fashion. In addition, doors 196, 198 are hinged to panels 182, 184. A lock system including elongated tape 152 is routed vertically within a T-shaped groove in panel 184 past drawers 188, 190, 192 and 194. Tape 152 supports studs 154 to lock and unlock the drawers in the same manner as the embodiment of FIGS. 1–6. Tape 154 is guided past the corner defined by side panel 184 and top 186 by a tape guide 62. Horizontal portion 156 of tape 152 is retained within a channel or T-shaped groove defined by the undersurface of top 186.

Figure 12:
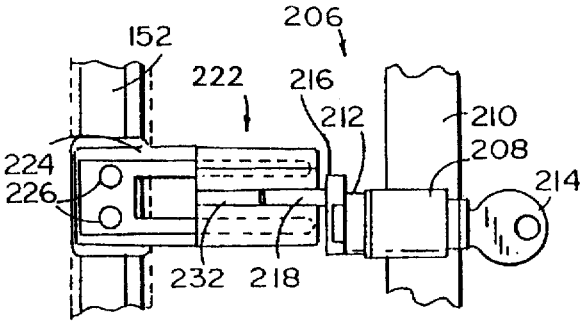
FIG. 12 is a fragmentary, enlarged, elevational view of a mechanical lock actuator incorporated in the embodiment of FIGS. 10 and 11.
Figure 13:
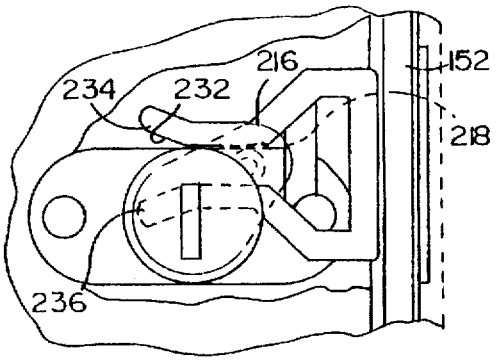
FIG. 13 is a fragmentary, front, elevational view of the lock actuator of FIG. 12.

A manual actuator 206 is provided for shifting tape 152 with respect to panel 184 and top 186. As best seen in FIGS. 12 and 13, actuator 206 includes a key cylinder 208 mounted in a front panel 210 of a moveable drawer 192. Cylinder 208 includes a barrel 212 rotated by a key 214. A lock cam 216 is secured to barrel 212. Cam 216 includes a pin 218 extending therefrom.

A lock lever 222 is fixed to tape 152. Lever 222 includes a body portion 224 attached to tape 152 by dual studs 226.

Body portion 224 defines an elongated, configured slot 232. Slot 232 includes outer inwardly converging sides 234, 236. With drawer 192 in the closed position, pin 218 of cam 216 is received within the configured slot 232 of lock lever 224. Rotation of barrel 216 through key 214 raises and lowers tape 152. Drawer 192 is opened and lock cylinder 208 moves therewith. When the drawer is closed, the pin is received in the slot of the lock lever. Entrance of the pin into the mouth of the slot is guided by the configuration of the slot. Manual actuator 206 is readily adapted to mounting on doors as well as drawers permitting the lock barrel portion to move with the moveable element or member of the article of furniture.

Figure 11:
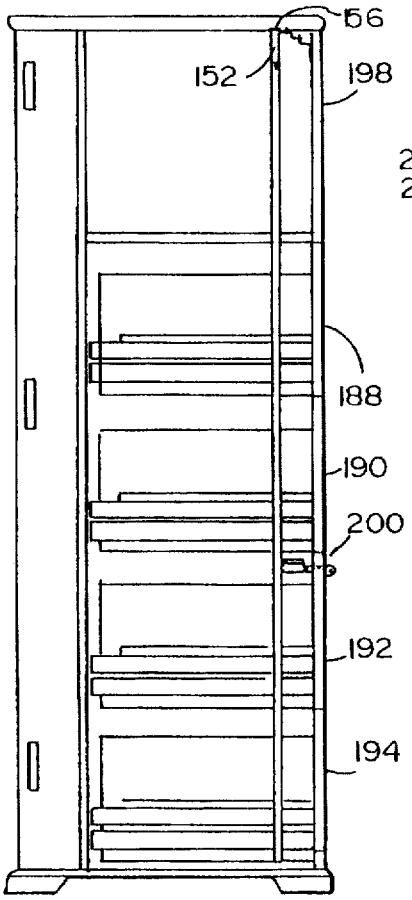
FIG. 11 is a side, elevational view of the article of FIG. 10 with a side panel removed.
Figure 14:
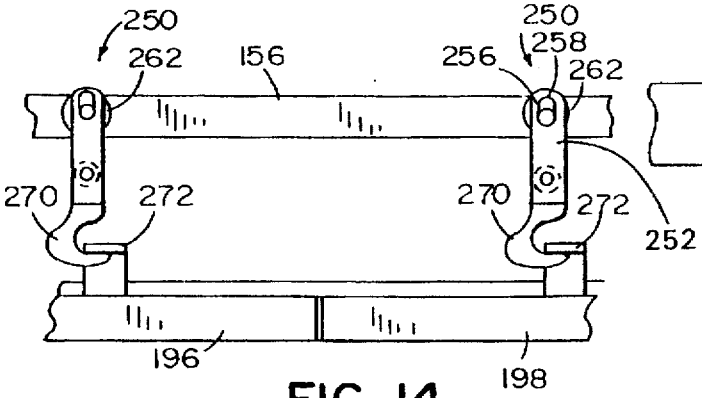
FIG. 14 is a fragmentary, plan view of the door lock and catch arrangement incorporated in the embodiment of FIGS. 10 and 11.
Figure 15:
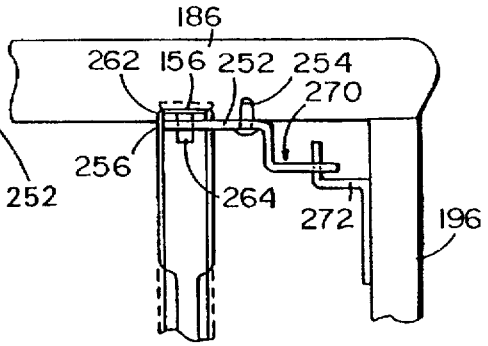
FIG. 15 is a fragmentary, side elevational view of the door lock and catch arrangement of FIG. 14.

As best seen in FIGS. 11, 14 and 15, a catch mechanism 250 is provided to latch doors 196, 198 in a closed, locked position. As shown, angled lock levers 252 are pivoted to the undersurface of top 186 by fasteners 254. Lock levers 252 each include an end 256 defining a slot 258. Lock studs 262 attached to tape horizontal portion 154 include stud portions 264 extending into slots 256. As a result, shifting of tape portion 156 to the right and left when viewed in FIG. 14 will pivot levers 252 between latched and unlatched positions. Levers 252 include a hooked-shaped portion 270. Each portion 270 engages a catch 272 fixed to an inner surface of each door 196, 198. When tape 156 is shifted to the right when viewed in FIG. 14, levers 252 are pivoted so that hooks 270 disengage from catches 272. Doors 196, 198 may be opened. When tape 156 is shifted to the left when viewed in FIG. 14, levers 252 pivot so that hooks 270 engage the catches, thereby latching the doors in a locked position.

Lock and Interlock Systems

Figure 16:
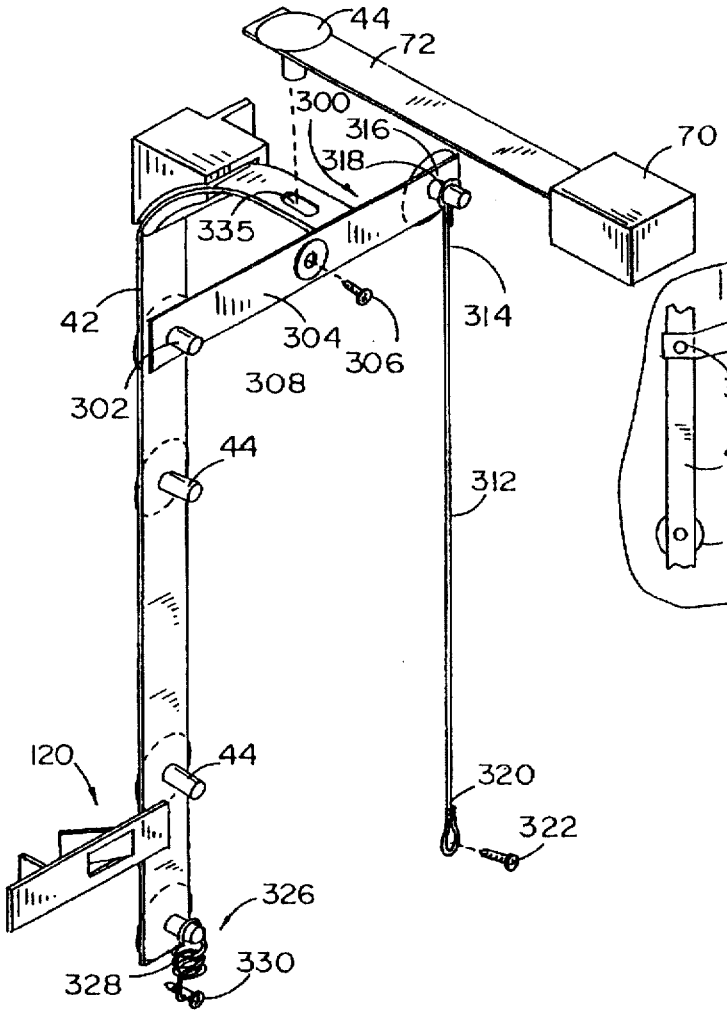
FIG. 16 is a schematic view illustrating a lock and interlock system in accordance with the present invention.
Figure 17:
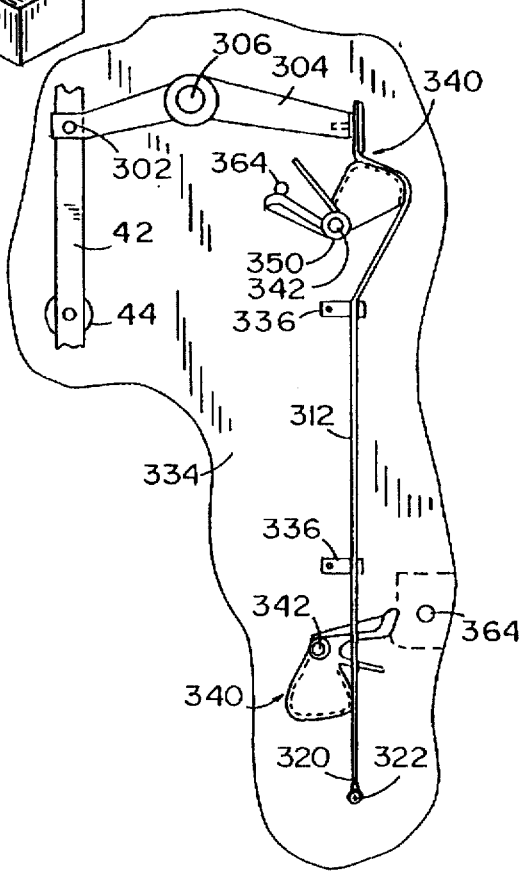
FIG. 17 is a fragmentary, elevational view of the lock interlock of FIG. 16.
Figure 18:
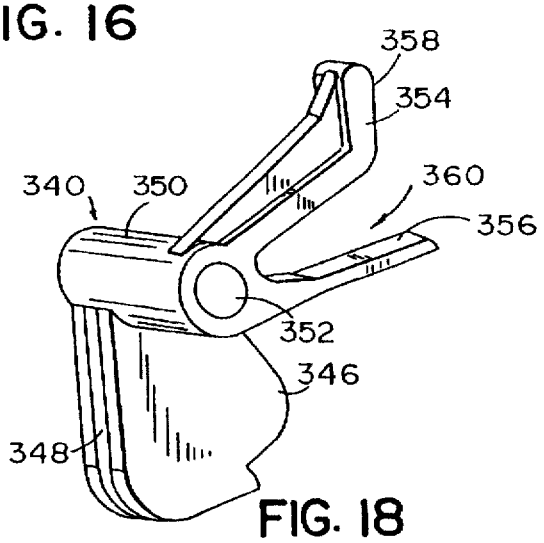
FIG. 18 is an enlarged, perspective view of an interlock cam incorporated in the embodiment of FIG. 17.

In certain installations, such as lateral and vertical file cabinets, an interlock system is desired to prevent opening of more than one of the drawers and, hence, prevent tipping of the cabinet. An interlock mechanism which is readily integrated into the tape lock system in accordance with the present invention is illustrated in FIGS. 16, 17 and 18 and generally designated by the numeral 300. As shown, tape 42 is provided with an interlock stud 302. An interlock lever 304 is pivotally mounted on an inner surface of the cabinet by a fastener 306. An end 308 of lever 304 defines an aperture through which stud 302 extends. A cable 312 has an upper end 314 attached to the opposite end 316 of lever 304 by a stud 318. A lower end 320 of cable 312 is fixed to a ground point on the inner surface of the cabinet by a fastener 322. As should be apparent, pulling on or taking up cable 312 will cause lever 304 to pivot in a clockwise direction about fastener 306. Such pivoting movement will raise lock member 42 to move the lock studs to the locked position. Tape lock member 42 is resiliently biased to an unlocked position by a spring 326 connected to a lower end 328 of tape 42 and to the inner surface of the cabinet by a fastener 330.

Upper end of tape 42, as shown in FIG. 16, defines an elongated slot 335. A stud 44 of actuator tape 72 extends into slot 335. When actuator 70 is in the unlocked position, elongated slot 335 permits tape 42 to be raised to the locked position by the interlock mechanism. The slot, therefore, permits the tape lock 42 to function both as a lock and as an interlock.

As shown in FIG. 17, a lock and interlock system is mounted on the inner surface 334 of the cabinet. Cable guides 336 are positioned in vertically spaced relationship and in engagement with cable 312. A plurality of interlock actuator cams 340 are pivotally or rotatably mounted on inner surface 344 by pivot fasteners 342. As seen in FIGS. 17 and 18, cams 340 include a configured body portion 346 having a grooved peripheral surface 348. Cam 340 further includes a pivot portion 350 defining a throughbore 352 for receipt of fastener 342 and a pair of outwardly extending arms 354, 356. Arm 354 defines a pin abutment surface 358. The arms define a generally V-shaped slot 360. In addition, interlock control members or pins 364 are mounted on side panels of the drawers in the cabinet.

With all drawers closed and tape lock member 42 in the lowered or unlocked position, cams 340 are positioned so that cable 312 extends in a straight line from its ground point at lower end 320 to interlock lever 304. When a first or upper drawer is opened, as shown in FIG. 17, control member 364 engages arm 354 rotating cam 340 to engage cable 312. As shown, the cam takes up the cable pivoting interlock lever 304 about its pivot axis 306 to raise lock member 42. Control pin 364 and drawer catch 120 are positioned with respect to each other so that the catch will clear its respective lock stud before tape member 42 is raised to the locked position. Any attempt to open subsequent drawers is, however, prevented. The drawers cannot be opened since tape lock member 42 has been raised to the locked position. The drawer catches will engage their respective lock studs.

If an attempt is made to open two drawers at once, the profile of the actuating cam bodies 346 is such that cable is taken up rapidly and tape lock member 42 is raised to a locked position before catches 120 can clear studs 44. The timing and operation of the interlock is therefore dependent upon the positioning and geometric or physical relationship between catches 120, control members 364 and cams 340.

When an open drawer is returned to the closed position, control member 364 engages arm 356 rotating cam 342 in its initial position. This permits lever 354 to rotate in a counterclockwise direction when viewed in FIG. 17, and tape 42 is returned to its unlocked position under the resilient bias of spring 326. The lock system, therefore, readily accommodates and integrates an interlock system. As should be appreciated, however, the interlock is readily adapted for use with conventional vertical bar or rod lock systems.

Figure 21:
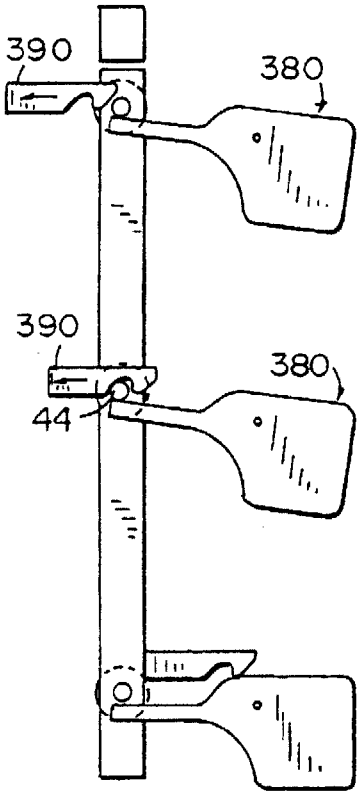
FIGS. 19, 20 and 21 are elevational views illustrating the operation of an alternative interlock system in accordance with the present invention.
Figure 20:
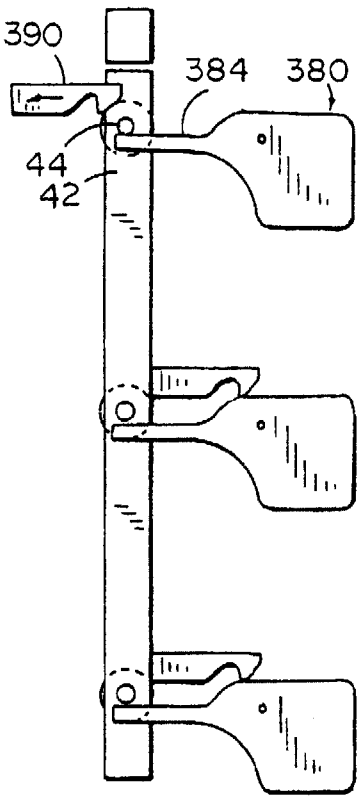
Figure 19:
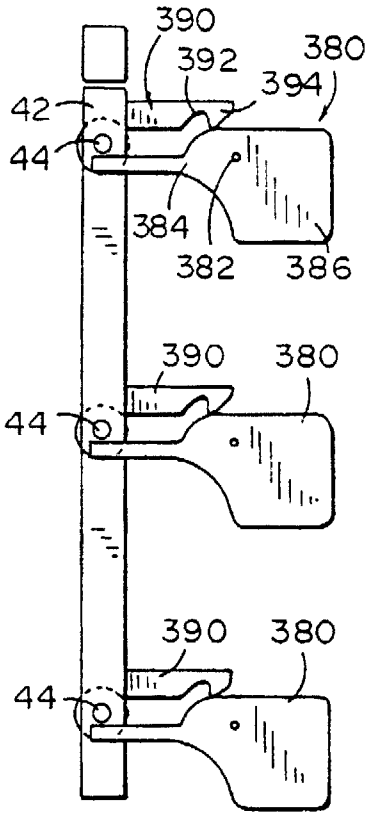

An alternative interlock system in accordance with the present invention is schematically illustrated in FIGS. 19–21. In this embodiment, a plurality of vertically spaced force generating means or members 380 are pivotally mounted on an inner surface of the cabinet at pivot points 382. Members 380 each include an arm portion 384 which is engagable with tape lock 42 at stud 44. Member 380 also includes a weight 386. The weight causes member 380 to rotate about axis 382 in a clockwise direction. A control or catch designated 390 is attached to each drawer. Catch 390 is substituted for the drawer catches 120 of the prior embodiments. Catch 390 is an elongated member which defines a hook portion 392 adjacent an end 394. When all drawers are in the closed position, as schematically illustrated in FIG. 19, ends 394 of each catch 390 will engage force generating members 380. Catches 390 maintain members 380 in the generally horizontal position illustrated. When a drawer, as illustrated in FIG. 20, is shifted to an open position, its catch 390 will move off of its respective member 380. Arm 384 will rotate into engagement with stud 44. The force generated by a single member 380 is insufficient to raise lock member 42 from the unlocked to the locked position. However, as shown in FIG. 21, should an attempt be made to open a second drawer before the first or upper most drawer is returned to its closed position, the catch of the second drawer will move off its weight 380. The force generated by both members 380 is sufficient to overcome the weight of tape lock 42 and move it to a raised position. Lock 42 is raised to the locked position so that a lock stud 44 will engage the catch 390 of the second drawer which has been attempted to be opened. The force bearing members 380, therefore, perform in an additive force manner. The additive force generated by each of the members is necessary to move the tape lock member 42 so that member 42 performs the interlock function. The additive weight or force feature, coupled with the configuration of catches 390, permits the system to function as a lock and interlock system. The length of the catch and the additive force on member 380 prevents the user from attempting to pull two drawers out at the same time. As soon as two drawers are moved, tape member 42 will raise to the locked position. If only a single drawer is opened, however, its member 380 generates an insufficient force to raise the lock member. Catch 390 will move past its respective lock stud.

Figure 22:
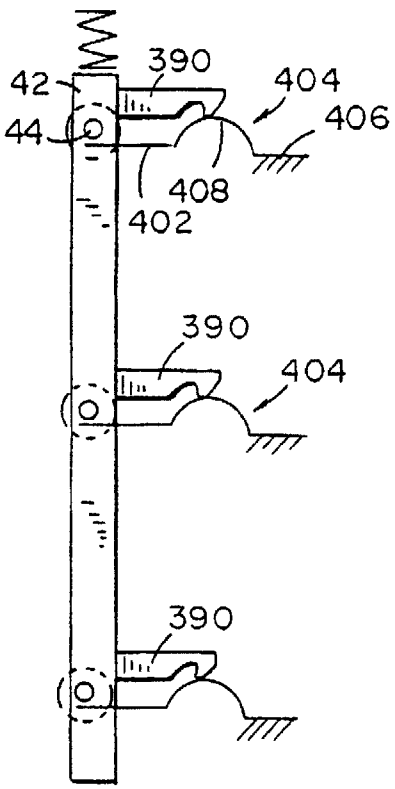
FIG. 22 is an elevational view illustrating a still further alternative interlock system in accordance with the present invention.

A still further alternative embodiment is illustrated in FIG. 22. The embodiment of FIG. 22 functions on an additive force basis. Catches 390, as with the embodiment of FIGS. 19–21, are mounted on their respective drawers. As schematically illustrated, arms 402 of force generating members 404 are positioned to engage lock studs 44 of tape 42. Members 404 have an end 406 fixed to the inner surface of the cabinet. An intermediate spring portion 408 resiliently biases arms 402 upwardly to generate a force which can be applied to lock member 42. The spring biased arms 402 function in the same manner as the weight biased arms 384 of the embodiment of FIGS. 19–21.

The lock system in accordance with the present invention is readily integrated into existing furniture. The flexible tape feature provides ease of routing of the tape system through the furniture. The system is readily adapted to ganged operation to lock multiple drawers in multiple pedestals and the like from a remote location and to lock doors and drawers in the same cabinet. The system is readily adaptable to manual and electrical or electronic actuation. In addition, an interlock mechanism is readily incorporated so that the lock may function as both a lock and interlock system. The interlock mechanisms disclosed are adaptable to conventional lock bar, gravity dependent systems. In view of the above description, therefore, those of ordinary skill in the art may envision various modifications which would not depart from the inventive concepts disclosed herein. It is expressly intended, therefore, that the above description should be considered as only that of the preferred embodiments. The true spirit and scope of the present invention may be determined by reference to the appended claims.

The embodiments of the invention in which an exclusive property or privilege is claimed are defined as follows:

1. A lock/interlock mechanism for use with a unit having an interior surface and at least two drawers slideably mounted therein, said mechanism comprising:

an elongated drawer lock member having a plurality of lock elements positioned thereon in vertically spaced relationship;

mounting means on the interior surface of the unit for mounting said drawer lock member for movement between unlocked and locked positions;

an interlock lever pivoted to the interior surface adjacent said mounting means, said lever including an interlock end operatively connected to said lock member so that pivoting of the lever moves said lock member between said positions;

an elongated, flexible member having a ground end fixed to the interior surface and an interlock end connected to said interlock lever;

a plurality of interlock cams pivoted to the interior surface, each cam being rotatable into engagement with the flexible member to pivot said interlock lever; and a plurality of controls, each control connected to one of the drawers so that opening movement of one of the drawers causes the control to engage and rotate one of the cams to pivot said lever and move said lock member to its locked position to prevent opening of any remaining drawers.

2. A mechanism as defined by claim 1 further comprising a plurality of drawer catches each mounted on one of the drawers and positioned to engage one of the lock elements when said lock member is in the locked position.

3. A mechanism as defined by claim 2 wherein said lock member is an elongated, flexible tape having a lower end and an upper end.

4. A mechanism as defined by claim 3 further including resilient biasing means connected to the lower end of said tape for resiliently biasing said tape to the unlocked position.

5. A mechanism as defined by claim 4 wherein said mounting means comprises an elongated chapel defined by said interior surface of said unit, said channel dimensioned to slideably receive said tape.

6. A mechanism as defined by claim 5 wherein each control comprises a pin secured to one of said drawers in spaced relationship with one of said catches.

7. A mechanism as defined by claim 6 wherein said cams each comprise a cam body defining a peripheral surface engaging said flexible member, said surface configured to take up the flexible member upon rotation of the cam.

8. A mechanism as defined by claim 7 wherein said cams each further define a slot dimensioned and positioned to receive one of said pins so that opening and closing movement of one of said drawers rotates said cam.

9. A mechanism as defined by claim 8 wherein said upper end of said tape defines an elongated slot.

10. A mechanism as defined by claim 9 further comprising a lock actuator having an actuator member disposed within said slot, said slot dimensioned to permit said lock member to move to the locked position when the lock actuator is in an unlocked position.

* * * * *

UNITED STATES PATENT AND TRADEMARK OFFICE

CERTIFICATE OF CORRECTION

PATENT NO. : 5,709,442
DATED : January 20, 1998
INVENTORS : Thomas G. Feldpausch et al.

It is certified that error appears in the above-identified patent and that said Letters Patent is hereby corrected as shown below:

Column 3, line 12;
After "Fig. 6" insert --is--.

Column 10, claim 5, line 32;
"chapel" should be --channel--.

Signed and Sealed this

Seventh Day of April, 1998

Bruce Lehman

*Attest:*

BRUCE LEHMAN

*Attesting Officer*

*Commissioner of Patents and Trademarks*